United States Patent [19]

Sakamoto et al.

[11] 4,387,595

[45] Jun. 14, 1983

[54] FLOAT OF SLURRY PRESSURE FEEDING SYSTEM

[75] Inventors: Masakatsu Sakamoto, Matsudo; Kenji Uchida; Shuichi Nagano, both of Kashiwa, all of Japan

[73] Assignee: Hitachi, Ltd., Tokyo, Japan

[21] Appl. No.: 250,665

[22] Filed: Apr. 3, 1981

[30] Foreign Application Priority Data

Apr. 9, 1980 [JP] Japan ..... 55-45590

[51] Int. Cl.[3] ..... G01F 23/06

[52] U.S. Cl. ..... 73/322.5; 141/18; 141/94; 222/62; 222/68

[58] Field of Search ..... 116/228; 73/322.5, DIG. 5; 200/61.2, 61.21; 141/94, 95, 96, 192–198, 2, 18–29, 35, 36; 222/62, 66, 67, 68, 64, 65, 63

[56] References Cited

U.S. PATENT DOCUMENTS

| | | | |
|---|---|---|---|
| 2,685,797 | 8/1954 | Morschel | 73/DIG. 5 |
| 3,389,603 | 6/1968 | Jacobs | 73/DIG. 5 |
| 3,678,750 | 7/1972 | DiNoia | 73/DIG. 5 |
| 3,685,357 | 8/1972 | Alexander | 73/DIG. 5 |
| 3,688,795 | 9/1972 | Taylor | 73/DIG. 5 |

FOREIGN PATENT DOCUMENTS

| | | | |
|---|---|---|---|
| 597929 | 3/1978 | U.S.S.R. | 73/322.5 |

*Primary Examiner*—Houston S. Bell, Jr.

*Attorney, Agent, or Firm*—Antonelli, Terry & Wands

[57] ABSTRACT

A float of a system for pressure feeding of slurry including a main body in the form of a bellows having a liquid and a gas sealed therein. The float has an apparent specific gravity which may vary depending on the value of pressure of a slurry or a driving liquid, whereby the slurry can be continuously fed from at least one slurry supply chamber by a driving liquid under high pressure to a desired destination.

10 Claims, 6 Drawing Figures

FLOAT OF SLURRY PRESSURE FEEDING SYSTEM

BACKGROUND OF THE INVENTION

1. Field of the Invention

This invention relates to pressure feeding systems and more particularly to a float suitable for use in a system for pressure feeding of slurry.

2. Description of the Prior Art

A system for pressure feeding of slurry of the prior art will be described by referring to FIG. 1, wherein the numerals 1–3 designate supply chambers, and the symbol T designates a slurry tank storing a slurry introduced into the supply chambers 1–3 by a slurry pump SP. The slurry introduced into the supply chambers 1–3 is discharged therefrom through discharge pipes 7–9 respectively.

Slurry supply pipes 4–6 supplying slurry from the slurry tank T to the slurry chambers 1–3 mount check valves $B_1$–$B_3$ respectively, and the slurry discharge pipes 7–9 mount check valves $D_1$–$D_3$ respectively. A driving liquid is stored in a driving liquid tank OT and introduced by a high pressure pump LP into the supply chambers 1–3 through pipes 10–12 respectively. The driving liquid introduced into the supply chambers 1–3 is returned through pipes 13–15 to the driving liquid tank OT respectively.

Change-over valves $A_1$–$A_3$ are mounted in the pipes 10–12 and change-over valves $C_1$–$C_3$ are mounted in the pipes 13–15 respectively. The symbols $F_1$–$F_3$ designate floats located in the supply chambers 1–3 respectively and floating in the interface between the driving liquid and the slurry therein. Sensors $SH_1$–$SH_3$ and $SL_1$–$SL_3$ are for sensing the upper and lower limits of the floats $F_1$–$F_3$ respectively.

The manner in which the slurry is fed from one supply chamber will be described. As shown, the supply chamber 1 is filled with the driving liquid. Actuation of the slurry pump SP with the check valve $D_1$ in the slurry discharge pipe 7 and the change-over valve $A_1$ in the pipe 10 being closed and the change-over valve $C_1$ in the pipe 13 being open supplies the slurry from the slurry tank T to the supply chamber 1 by opening the check valve $B_1$ in the slurry supply pipe 4 and discharges the driving liquid in the supply chamber 1 through the change-over valve $C_1$. This causes the interface between the driving liquid and slurry or the float therein to rise. Upon the sensor $SH_1$ sensing the arrival of the float $F_1$ at its upper limit, the change-over valve $C_1$ is closed and the change-over valve $A_1$ is opened. Actuation of the high pressure pump LP opens the check valve $D_1$, and the driving liquid presses the slurry and urges same downwardly, so that the slurry is forced out of the supply chamber 1 into the discharge pipe 7. By actuating the supply chambers 1–3 in chronological sequence in accordance with a suitable timetable, the slurry can be continuously fed under pressure from the supply chambers 1–3.

In the aforesaid system for feeding the slurry under pressure, the pressure in each of the supply chambers 1–3 reaches several kg/cm$^2$ when the slurry pump SP is actuated to fill the slurry chambers with the slurry, and the pressure in each of the supply chambers 1–3 reaches several scores of kg/cm$^2$ when the high pressure pump LP is actuated to feed the slurry in the supply chambers under pressure to its destination. This makes it necessary to fabricate the floats $F_1$–$F_3$ such that they can withstand changes in pressure. It has hitherto been usual practice to form the float in hollow, sealed spherical construction and to design the specific gravity of the float to give to it an apparent specific gravity, or total weight per total volume of float, which is midway between the slurry and that of the driving liquid. This type of float is capable of withstanding an external pressure when the pressure is low. However, when the pressure rises above a certain level, difficulties are experienced in imparting to the float enough strength to withstand an external pressure with this apparent specific gravity. Meanwhile the apparent specific gravity would become too high if the thickness of the float is increased to enable it to withstand the high external pressure. Thus the maximum pressure that the floats of the prior art have been able to withstand could be about 50–60 kg/cm$^2$.

To this problem, proposals have been made to fill a charge of liquid in the float and to attach a bellows thereto to equalize the pressure inside and outside the float. However, this has not made it any easier to obtain a float with a predetermined apparent specific gravity. For one thing, the liquid to be filled in the float should be low in gravity, but such liquid is not readily obtainable. For another, if the float is covered with a shell of metal, then it is inevitable that the float has a substantial weight.

SUMMARY OF THE INVENTION

Accordingly this invention has as its object the provision of a float suitable for use with a system for pressure feeding of slurry which enables a predetermined apparent specific gravity to be readily obtained.

The outstanding characteristic of the invention is that the float comprises a hollow main body formed as of bellows, and a liquid and a solid sealed in the hollow body to permit the apparent specific gravity, i.e., total weight per total volume of float, of the float to vary depending on the value of the pressure of a slurry or a driving liquid.

Figure 1:
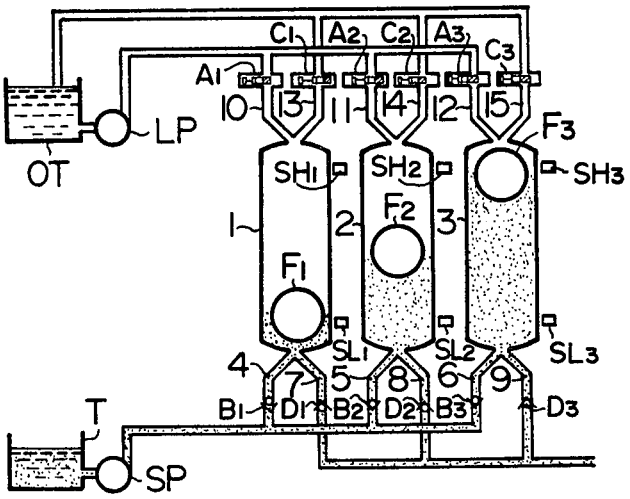
FIG. 1 PRIOR ART
FIG. 1 is a diagrammatic representation of a system for pressure feeding of slurry.
Figure 2A:
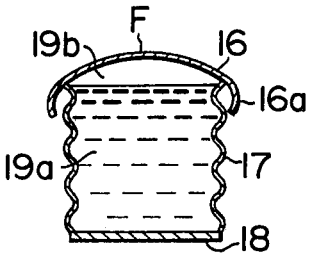
Figure 2B:
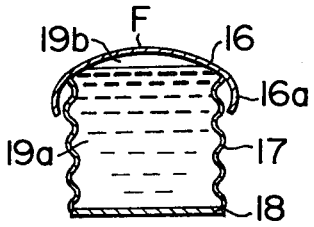

FIGS. *2a* and *2b* are a schematic view of the float according to the invention, showing its construction; and FIGS. *3a*, *3b* and *3c* are a view in explanation of the operation of the float shown in FIG. 2.

DESCRIPTION OF THE PREFERRED EMBODIMENT

A preferred embodiment of the invention will now be described by referring to FIGS. 2 and 3. In FIG. 2, there is shown a float F comprising a convex head plate 16 including a sliding surface **16*a* formed on the side thereof facing the wall of a supply chamber, a bellows-like main body 17 which is freely contracted and expanded, and a weight bottom plate 18 for placing the center of gravity of the float F in a lower portion thereof. The float F contains a liquid 19*a* and a gas 19*b* sealed therein. The liquid 19*a* may comprise light oil with a specific gravity of 0.85, and the gas 19*b* may comprise nitrogen gas with a specific gravity of 0.96. The float F in a condition (a) shows that the external pressure acting on the float F is a high pressure. When the float F is in a condition (b), the volume of the section thereof containing the gas 19b is smaller than when the float F is in the condition (a) because the gas 19b is compressed. By utilizing this fact, it is possible to select the volumes of the liquid 19a and the gas 19b sealed in the body 17** of the float in such a manner that the apparent specific gravity of the float F is lower than the specific gravity of the driving liquid at all times when the pressure applied thereto is low and higher than the specific gravity of the driving liquid at all times when the pressure applied thereto is high.

Figure 3A:
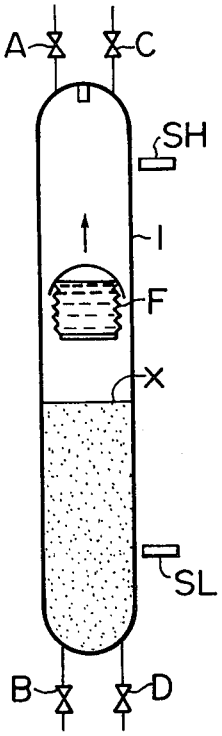
Figure 3B:
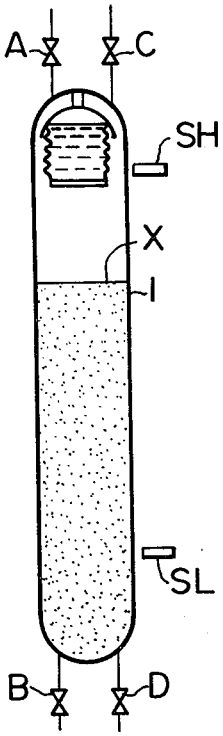
Figure 3C:
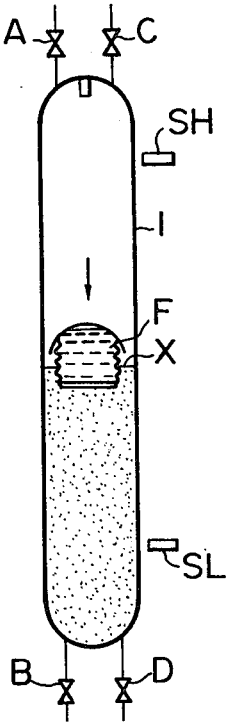

FIG. 3 shows a system for pressure feeding of slurry provided with the float F according to the invention shown in FIG. 2. The supply chamber 1 in a condition (a) is receiving a charge of slurry from the tank T by the slurry pump SP through the supply pipe 4 and check valve 8. This condition shows the supply chamber 1 at low pressure in which the apparent specific gravity of the float F is lower than the specific gravity of the driving liquid, so that the float F rises at a speed higher than the speed of which the interface X between the slurry and driving liquid rises (in the direction of an arrow).

When the supply chamber 1 is in a condition (b), supply of the charge of slurry thereto has been completed. In this condition, the specific gravity of the float F is lower than the specific gravity of the driving liquid, and the float F reaches the upper end of the supply chamber 1 in its upward movement. However, since the interface X between the slurry and driving liquid rises at a speed lower than the speed of upward movement of the float F, the interface X is disposed below the float F and prevents the slurry from leaking through the change-over valve C to the driving liquid side.

The supply chamber 1 in a condition (c) is feeding under pressure the slurry therefrom through the discharge pipe 7 and check-valve D, and the pressure in the supply chamber is high. At this time, the volume of the gas in the float F is reduced because it is compressible and the apparent specific gravity of the float F becomes higher than the specific gravity of the driving liquid, so that the float F moves downwardly (in the direction of an arrow) and stops in the position of the interface X between the slurry and driving liquid. This prevents the excess driving liquid in the supply chamber 1 from leaking through the check valve D.

When the gas 19b is nitrogen gas, the light oil used as the liquid 19a can be advantageously prevented from undergoing oxidation.

While the system for pressure feeding of slurry using the float F according to the invention has been described as including one slurry supply chamber 1, it is to be understood that the performance of the float F is no different when the system has a plurality of supply chambers 1 from the performance described hereinabove.

From the foregoing description, it will be appreciated that according to the invention the float has its apparent specific gravity varied depending on the value of pressure of a slurry or a driving liquid. By virtue of this feature, when a charge of slurry is supplied to the slurry supply chamber the float moves upwardly ahead of the interface formed between the slurry and the driving liquid as the volume of the slurry in the supply chamber increases, thereby avoiding incorporation of the slurry in the driving liquid. This is conducive to marked increase in the service life of the driving liquid and a reduction in damage caused to the equipment of the driving liquid feed line. Changes in pressure applied to the float can be accommodated by the use of the bellows-like main body of the Float, so that it is possible to increase the pressure under which the slurry is fed in the system for pressure feeding of slurry.

What is claimed is:

1. A float of a system for pressure feeding of slurry comprising at least one slurry supply chamber provided with the float, said slurry supply chamber being operative to receive a charge of slurry under low pressure and feed same by a driving liquid under high pressure from the supply chamber to a desired destination, such float comprising:

a float body which has a bellows portion and which encloses a volume, wherein said volume contains a gas and a liquid sealed in said float body, said gas and liquid being sealed in said float body to occupy volume portions of said volume such that the total weight per total volume of the float changes according to the pressure of the driving liquid and slurry.

2. A float as claimed in claim 1, wherein said float body has a gas volume portion and liquid volume portion such that the float body has a total weight per total volume that is lower than the specific gravity of the driving liquid when the slurry supply chamber is under low pressure and higher than the specific gravity of the driving liquid and lower than the specific gravity of the slurry when the slurry chamber is under high pressure.

3. A float as claimed in claim 1, wherein said float body has a bellows portion so as to have a contracted float body when said gas is at higher pressure and an expanded float body when said gas is at lower pressure.

4. A float as claimed in claim 1, wherein the liquid sealed in the float body comprises light oil.

5. A float as claimed in claim 1, wherein the gas sealed in the float body comprises nitrogen gas.

6. A float as claimed in claim 1, wherein the gas and liquid are sealed in the float body to occupy volume portions such that the total weight per total volume of the float changes sufficiently to enable the float to move upwardly ahead of the interface between the slurry and the driving liquid as the volume of the slurry in the slurry supply chamber increases as slurry is supplied to the slurry supply chamber.

7. A float as claimed in claim 1, having a convex head portion attached to said bellows portion.

8. A system for pressure feeding of slurry comprising at least one slurry supply chamber provided with a float, the slurry supply chamber being in flow communication with means for delivering a charge of slurry under low pressure to said slurry supply chamber and means for feeding said slurry by a driving liquid under high pressure from said slurry supply chamber to a desired destination, wherein said float comprises:

a float body which has a bellows portion and which encloses a volume, wherein said volume contains a gas and a liquid sealed in said float body, said gas and liquid being sealed in said float body to occupy volume portions of said volume such that the total weight per total volume of the float changes according to the pressure of the driving liquid and slurry.

9. A system as claimed in claim 8, wherein said float body has a gas volume portion and liquid volume portion such that the float has a total weight per total volume that is lower than the specific gravity of the driving liquid when the slurry supply chamber is under low pressure and higher than the specific gravity of the driving liquid and lower than the specific gravity of the slurry when the slurry chamber is under high pressure.

10. A system as claimed in claim 8, wherein the gas and liquid are sealed in the float body to occupy volume portions such that the total weight per total volume of the float changes sufficiently to enable the float to move upwardly ahead of the interface between the slurry and the driving liquid as the volume of the slurry in the slurry supply chamber increases as slurry is supplied to the slurry supply chamber.

* * * * *